US006069602A

United States Patent [19]

Tanaka et al.

[11] Patent Number: 6,069,602

[45] Date of Patent: May 30, 2000

[54] LIQUID CRYSTAL DISPLAY DEVICE, LIQUID CRYSTAL DISPLAY APPARATUS AND LIQUID CRYSTAL DRIVING METHOD

[75] Inventors: Tomio Tanaka, Hachioji; Tetsushi Yoshida, Kanagawa-ken; Katsuhiko Morosawa, Fussa, all of Japan

[73] Assignee: Cassio Computer Co., Ltd., Tokyo, Japan

[21] Appl. No.: 08/703,369

[22] Filed: Aug. 26, 1996

[30] Foreign Application Priority Data

Aug. 31, 1995 [JP] Japan ..... 7-245171
Dec. 28, 1995 [JP] Japan ..... 7-352388

[51] Int. Cl.[7] ..... G09G 3/36

[52] U.S. Cl. ..... 345/89; 345/96

[58] Field of Search ..... 345/87, 89, 96, 345/97

[56] References Cited

FOREIGN PATENT DOCUMENTS 4-190329 7/1992 Japan .

OTHER PUBLICATIONS

Liquid Crystals, 1989, vol. 5, No. 4, pp. 1171–1177, Deformed helix ferroelectric liquid crystal display: a new electrooptic mode in ferroelectric chiral smectic C liquid crystals, L.A. Beresnev, et al.

*Primary Examiner*—Matthew Luu
*Attorney, Agent, or Firm*—Frishauf, Holtz, Goodman, Langer & Chick, P.C.

[57] ABSTRACT

A liquid crystal display device includes a first substrate having pixel electrodes and active elements formed thereon in a matrix form, a second substrate having common electrodes formed thereon which face the pixel electrodes, and a liquid crystal located between the first and second substrates and having a spontaneous polarization. The ON current of the active elements satisfies the following equation (11):

$$4 \times Ps \times S/TS \quad (11)$$

where S is the area of each pixel, Ps is a spontaneous polarization per unit area, TS is the selection time of each pixel and Ion is the ON current.

19 Claims, 13 Drawing Sheets

$$\Delta Q = 2 \cdot Ps \cdot S$$

VIDEO SIGNAL
FIRST FRAME
SECOND FRAME
THIRD FRAME
D11D12D13D14D15D16D17D18D19D110
D21D22D23D24D25D26D27D28D29
D31D32D33D34D35D36D37D38D39
D41D42D43
ONE FRAME OF DISPLAYED IMAGE
FIRST FIELD
SECOND FIELD
THIRD FIELD
D11
D14
D17
D22
D25
D28
D33
D36
D39
D41
D44

G1

G2

G3

G4

Dkl : k FRAME NUMBER
l SCAN LINE NUMBER

LIQUID CRYSTAL DISPLAY DEVICE, LIQUID CRYSTAL DISPLAY APPARATUS AND LIQUID CRYSTAL DRIVING METHOD

BACKGROUND OF THE INVENTION

1. Field of the Invention

The present invention relates to a liquid crystal display device which uses a liquid crystal having a spontaneous polarization, a liquid crystal display apparatus and a liquid crystal driving method.

2. Description of the Related Art

Conventional liquid crystal display (LCD) devices generally use a nematic liquid crystal. But, LCD devices using a nematic phase suffer a narrow view angle (a narrow area from which a display image having a sufficient contrast can be observed).

Attention has recently been given to LCD devices which use a liquid crystal having a spontaneous polarization, such as a ferroelectric liquid crystal or an antiferroelectric liquid crystal. Such LCD device can display high-quality images and have a high response characteristic.

Studies to make a practical use of LCD devices using this kind of liquid crystal have been made mainly on a ferroelectric liquid crystal called "SS-F liquid crystal." The SS-F liquid crystal has a bistable (memory property) alignment state and is suitable for simple matrix driving. The SS-F liquid crystal however has such a shortcoming that the transmittance cannot be changed stepwisely, disabling gradation display.

As a solution to this problem, it has been proposed to effect the active matrix driving of the SS-F liquid crystal to steadily apply an intermediate voltage to the SS-F liquid crystal and to control the ratio of the white display area to the black display area to ensure pseudo gradation display.

According to this driving method, the aligning state of the liquid crystal changes even if the same voltage is applied to the liquid crystal. Therefore, it is difficult to display an arbitrary gradation stably and certainly.

To overcome this problem, ferroelectric liquid crystal LCD devices which can ensure stable gradation display have been studied, and there has been proposed ferroelectric liquid crystals whose chiral smectic phases have a helical pitch smaller than the gap between the substrates of the LCD device. Of the ferroelectric liquid crystals of this type, one which has a memory, property is called an SBF liquid crystal and one which has a non-memory property is called a DHF liquid crystal (see "LIQUID CRYSTALS," 1989, Vol. 5, NO. 4, pp 1171 to 1177).

When a voltage whose absolute value is sufficiently large is applied between the opposing electrodes which sandwich the liquid crystal (LC) layer, the DHF liquid crystal becomes either a first alignment state where the directors of the LC molecules are substantially aligned in a first direction or a second alignment state where the directors of the LC molecules are substantially aligned in a second direction in accordance with the polarity of the applied voltage. When the absolute value of the applied voltage is smaller than the one which sets the first alignment state or the second alignment state, the DHF liquid crystal becomes an intermediate alignment state where the average direction of the directors of the LC molecules comes between the first and second directions due to the deformation of helical structure which the molecules draw, thus ensuring intermediate gradation display.

When a voltage whose absolute value is equal to or greater than a predetermined value is applied between the opposing electrodes which sandwich the LC layer, the SBF liquid crystal becomes either a first alignment state where the average of the directions of lengthwise axes, i.e., director of the LC molecules are substantially aligned in a first direction or a second alignment state where the directors of the LC molecules are substantially aligned in a second direction in accordance with the polarity of the applied voltage. When the absolute value of the applied voltage is smaller than the one which sets the first alignment state or the second alignment state, the SBF liquid crystal becomes an intermediate alignment state where the LC molecules whose directors are aligned in the first direction are mixed with the LC molecules whose directors are aligned in the second direction, thus ensuring intermediate gradation display.

Therefore, intermediate gradation can stably and certainly be displayed by keeping applying the intermediate voltage to the DHF liquid crystal or the SBF liquid crystal by active driving during the non-selection period.

The DHF liquid crystal, the SBF liquid crystal and the like have a spontaneous polarization. Therefore, the LCD device of this type has a larger capacitance of each pixel which is formed by a pixel electrode, the common electrode and the liquid crystal material interposed therebetween than that of the liquid crystal device using the nematic liquid crystal. Thus, the LCD device using the liquid crystal having the spontaneous polarization takes time to charge the individual pixels (to store charges), so that while this LCD device is characterized by the fast behavior of the LC molecules due to the interaction of the spontaneous polarization and the electric field, it suffers the long writing time of from a pixels and slow operation.

When the writing time (selection time) of the individual pixels is long, the number of displayable pixels is reduced so that a high image quality cannot be maintained. If the number of rows of pixels is kept constant, the frame frequency gets lower and displayed images suffer apparent flickering, which may result in the frame loss of moving pictures.

A simple way to shorten the writing time of the pixels is to set the voltage to be applied to the liquid crystal higher. The higher applied voltage, however, means that the breakdown voltages of the LCD device and the driving circuit should be increased.

SUMMARY OF THE INVENTION

Accordingly, it is an objective of the present invention to improve the operation speed of an active matrix type LCD device whose liquid crystal has a spontaneous polarization and which can provide gradation display.

It is another objective of this invention to provide an LCD apparatus which can display high-quality images and whose liquid crystal has a spontaneous polarization, and a method of driving such a liquid crystal.

It is a further objective of this invention to provide an LCD apparatus which can prevent a frame loss or the like of an displayed image and whose liquid crystal has a spontaneous polarization, and a method of driving such a liquid crystal.

To achieve the above objectives, an LCD device according to the first aspect of this invention comprises:

- a first substrate having pixel electrodes and active elements, connected to the pixel electrodes, formed thereon in a matrix form;
- a second substrate having common electrodes formed thereon facing the pixel electrodes; and a liquid crystal located between the first and second substrates and having a spontaneous polarization, the active elements being formed in such a manner that an allowable ON current of the active elements satisfies an equation (1):

$$4 \times Ps \times S/TS \quad (1)$$

where S is an area of each pixel, Ps is a spontaneous polarization per unit area, TS is a selection time of each pixel and Ion is the ON current.

The director of the LC molecules of the liquid crystal may be aligned substantially in a first direction when a voltage having a first polarity and equal to or greater than a first value is applied to the liquid crystal, and the director of the LC molecules of the liquid crystal may be aligned substantially in a second direction when a voltage having a second polarity and equal to or greater than the first value is applied to the liquid crystal; and each of the active elements may have an ON resistance satisfying an equation (2):

$$V1/Ion \geqq Ron \quad (2)$$

where V1 is the first value, Ion is the ON current of the active elements when the voltage with the first value V1 is applied to the liquid crystal, and Ron is the ON resistance.

This LCD device may further comprise a pair of polarization plates sandwiching the first and second substrates;

The director of the LC molecules of the liquid crystal may be aligned substantially in a first direction when a voltage having a first polarity and equal to or greater than a first value is applied to the liquid crystal, and the director of the LC molecules of the liquid crystal may be aligned substantially in a second direction when a voltage having a second polarity and equal to or greater than the first value is applied to the liquid crystal;

an optical axis of one of the pair of polarization plates may be set to an intermediate direction between the first direction and the second direction; and an optical axis of the other one of the pair of polarization plates may be set perpendicular or parallel to the optical axis of the one polarization plate.

This LCD device may further comprise a driving circuit, connected to the pixel electrodes and the common electrodes via the active elements, for applying voltages of different polarities to the pixel electrodes frame by frame with a voltage for the common electrodes taken as a reference.

The driving circuit applies one drive pulse to the liquid crystal with respect to one piece of display data for each pixel electrode while inverting a polarity of the drive pulse frame by frame, or applies two drive pulses of different polarities to the liquid crystal in two consecutive frames with respect to one piece of display data for each pixel electrode.

The liquid crystal may be one of an antiferroelectric liquid crystal, DHF liquid crystal and SBF liquid crystal.

To achieve the aforementioned objectives, an LCD apparatus according to the second aspect of this invention comprises:

an LCD device including a first substrate having pixel electrodes and active elements, connected to the pixel electrodes, formed thereon in a matrix form, a second substrate having common electrodes formed thereon facing the pixel electrodes, and a liquid crystal located between the first and second substrates and having a spontaneous polarization; and a driving circuit connected to the pixel electrodes via the active elements, whereby a drive current to be supplied via the active elements to capacitors, comprised of the pixel electrodes, the common electrodes and the liquid crystal therebetween, change with time in accordance with a change in alignment of the liquid crystal, the active elements having an allowable current characteristic equal to or greater than a maximum value of the drive current satisfying an equation (3):

$$4 \times Ps \times S/T = Imax \quad (3)$$

where S is an area of each pixel, Ps is a spontaneous polarization per unit area, TS is a selection time of each pixel and Imax is the maximum value of the drive current.

In this case, each of the active elements may have an ON resistance satisfying an equation (4):

$$Vmax/Imax \geqq Ron \quad (4)$$

where Imax is the maximum value of the drive current to be supplied to the capacitors, Vmax is a maximum value of a voltage to be applied to the pixel electrodes and the common electrodes by the driving circuit, and Ron is the ON resistance.

To achieve the aforementioned objectives, an LCD apparatus according to the third aspect of this invention comprises:

an LCD device including a first substrate having pixel electrodes and active elements, connected to the pixel electrodes, formed thereon in a matrix form, a second substrate having common electrodes formed thereon facing the pixel electrodes, and a liquid crystal located between the first and second substrates and having a spontaneous polarization; and drive means for selecting every (2×/N+1)-th row of pixels of the LCD device and writing image data in the selected row of pixels in each field and changing a row to be selected field by field, thereby displaying one screen by (2×/N+1) fields, N being a natural number.

In a specific example, the drive means comprises:

reception means for receiving image data defining a write voltage to each pixel;

thinning means for thinning each frame of image data in the image data received by the reception means to 1/(2×/N+1); and means for applying image data thinned by the thinning means to pixels of the LCD device for a time substantially (2×/N+1) times a continuation period of the image data.

Further, the pixel electrodes arranged in a matrix form, thin film transistors respectively connected to the pixel electrodes at one ends of current paths of the thin film transistors, a plurality of gate lines each connected to gates of an associated row of thin film transistors, and a plurality of data lines each connected to other ends of the current paths of an associated column of thin film transistors may be formed on the first substrate; and the drive means may include a gate driver for applying a gate pulse to every (2×/N+1)-th row of gate lines and a data driver for outputting the image data to the data lines.

The drive means may comprise:

reception means for receiving image data defining a write voltage to each pixel;

selection means for selecting one frame of image data in every (2×/N+1) frames of image data in the image data received by the reception means; and means for applying the frame of image data selected by the selection means to pixels of the LCD device for a time substantially (2×/N+1) times a continuation period of the image data.

Alternatively, the drive means may comprise:

storage means for receiving image data defining a display image at a predetermined reception speed and storing the image data at a frame speed of the image data;

reading means for reading every (2×/N+1)-th row of image data from the storage means at a speed 1/(2×/N+1) times the reception speed; and means for applying the image data, read by the reading means, to selected pixels.

To achieve the aforementioned objectives, a liquid crystal driving method according to the fourth aspect of this invention comprises the steps of:

receiving image data;

thinning the image data to 1/(2×/N+1); and selecting every (2×/N+1)-th row of pixels of an active matrix type LCD device using a liquid crystal having a spontaneous polarization, and changing a row to be selected field by field; and writing the thinned image data to the selected pixels.

Writing image data is executed by elongating a continuation period of the thinned image data to substantially (2×/N+1) times an original continuation period; and selecting each pixel of the LCD device for a period substantially (2×/N+1) times the continuation period of each image data and writing the thinned image data in the selected each pixel.

At the time of writing thinned image data in selected pixels, the polarity of a voltage to be applied to the liquid crystal of the LCD device may be inverted field by field, line by line or frame by frame.

DETAILED DESCRIPTION OF THE PREFERRED EMBODIMENTS

LCD devices embodying the present invention will now be described with reference to the accompanying drawings.

First Embodiment

Figure 1:
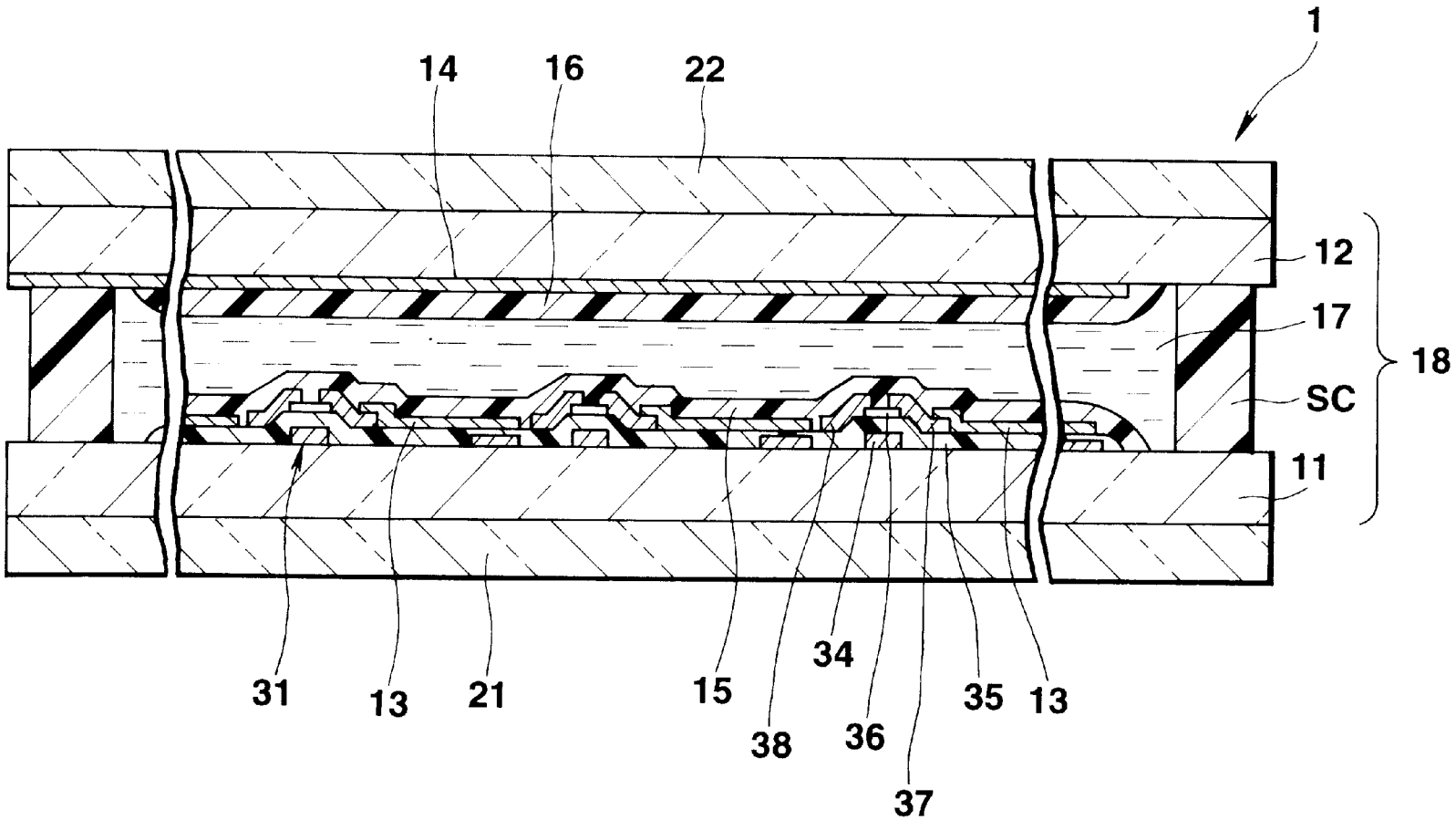
FIG. 1 is a cross-sectional view showing the structure of an LCD device embodying this invention.

FIG. 1 shows the cross-sectional structure of an active matrix type LCD device according to the first embodiment of this invention.

As illustrated, this LCD device comprises an LC cell 18, which includes a pair of substrates 11 and 12, a seal member SC for bonding the substrates 11 and 12, and a liquid crystal 17 sealed between the substrates 11 and 12 and the seal member SC, and a pair of polarization plates 21 and 22 which sandwich the LC cell 18.

The substrates 11 and 12 are comprised of insulating transparent substrates such as glass.

Figure 2:
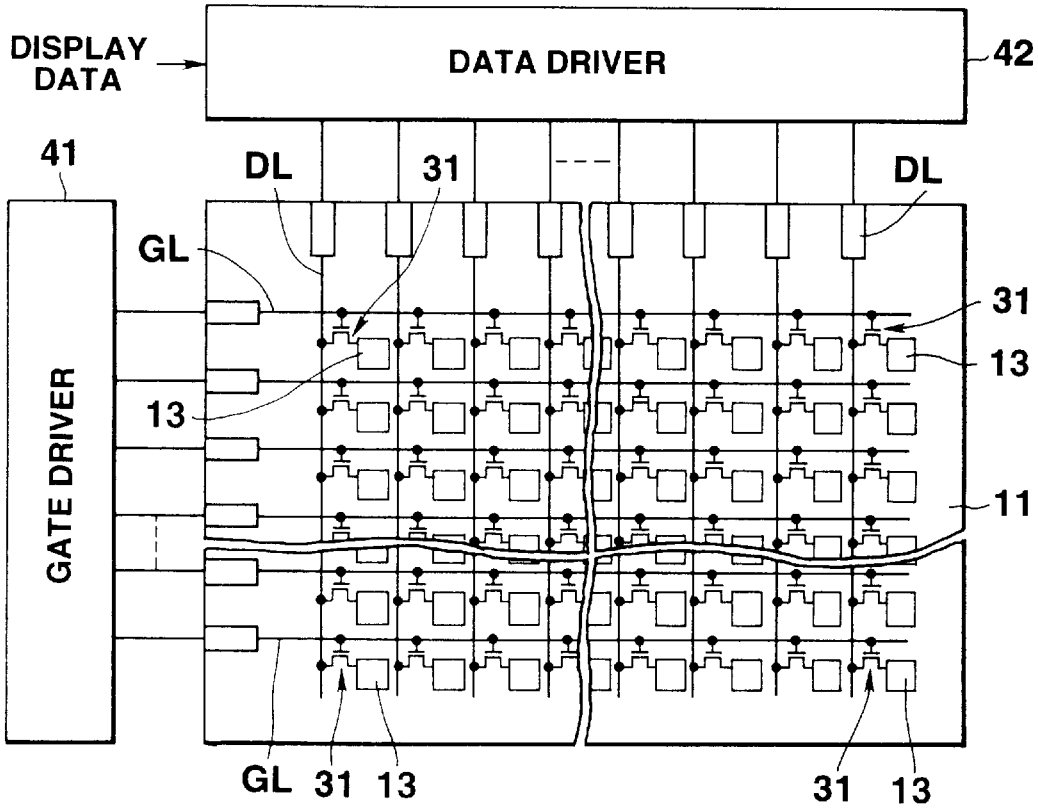
FIG. 2 is a plan view showing the structure of a lower substrate of the LCD device shown in FIG. 1.

Pixel electrodes 13 and TFTs (Thin Film Transistors) 31 are arranged on the substrate 11 in a matrix form, as shown in FIG. 2.

Each pixel electrode 13 is made of a transparent conductive material like ITO, and has an area S of, for example, approximately 200 to 100$\mu$×200 to 100$\mu$.

Each TFT 31 comprises a gate electrode 34 formed on the substrate 11, a gate insulating film 35 made of silicon nitride (SiN) or the like and covering the gate electrode 34, a semiconductor layer 36 formed on the gate insulating film 35 facing the gate electrode 34, a source electrode 37 connected to one end of the semiconductor layer 36, and a drain electrode 38 connected to the other end of the semiconductor layer 36. Each TFT 31 is turned on when a gate pulse is applied to the gate electrode 34, and has an ON resistance Ron of, for example, about 150 Ω.

The gate electrodes 34 of each row of TFTs 31 are connected to an associated gate line GL, the source electrodes 37 are connected to the associated pixel electrodes 13, and the drain electrodes 38 of each column of TFTs 31 are connected to an associated data line DL.

The individual gate lines GL are connected to a gate driver 41, and the individual data lines DL to a data driver 42.

The gate driver 41 sequentially applies gate signals to the gate lines GL to scan those gate lines GL. The data driver 42 applies data signals including gradations pulse whose absolute values correspond to the display gradations to data lines DL. The waveforms of the gate pulse and the gradation pulse will be discussed later with reference to FIGS. 5A and 5B.

An aligning film 15 is located on the individual pixel electrodes 13 and the TFTs 31.

Provided on the substrate 12 are common electrodes 14, which face the pixel electrodes 13 and are applied with a reference voltage $V_{com}$, and an aligning film 16 formed on the common electrodes 14. The common electrodes 14 are made of a transparent conductive material such as ITO. The reference voltage $V_{com}$ may be a constant voltage, or a voltage signal whose polarity is inverted every scanning line or frame, for example.

The aligning films 15 and 16 are formed of homogeneous aligning material such as polyimide-base aligning material. Aligning treatment like rubbing has been performed on the surfaces of the aligning films 15 and 16 in a predetermined direction.

The liquid crystal 17 has a spontaneous polarization Ps per unit area, and may be an antiferroelectric liquid crystal (hereinafter referred to as "AFLC"). The desirable AFLC should have a transmittance which continuously changes with respect to a change in applied voltage, and should not have a specific threshold value.

Figure 3:
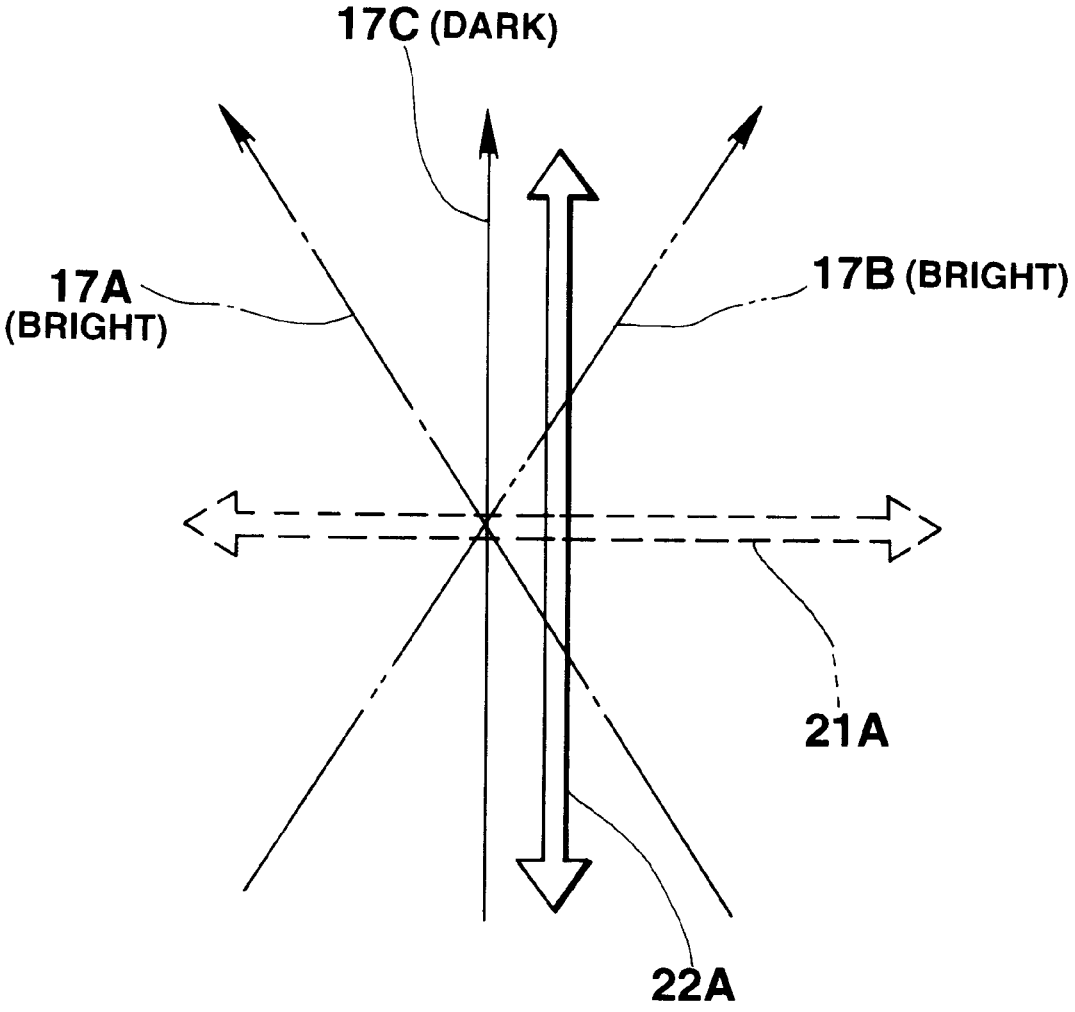
FIG. 3 is a plan view showing the directions of the transmission axes of upper and lower polarization plates and the aligning direction of LC molecules.

An AFLC having such a property may be acquired by mixing liquid crystal materials 1 to 3 whose skeletal structures are expressed by the following chemical formulae at a ratio of 20% by weight, 40% by weight and 40% by weight, respectively.

second direction 17B indicated by a two-dot chain line in FIG. 3, and the dipoles of the LC molecules show a ferroelectric phase.

When the applied voltage is 0, the LC molecules are alternately aligned in the first direction 17A and the second direction 17B, and the dipoles are canceled each other, showing an antiferroelectric phase. The average direction (director) of the lengthwise axes of the LC molecules becomes approximately the direction of the normal line to the smectic layer of the liquid crystal 17 (a layer of the layer structure of the liquid crystal in a smectic phase), i.e., an intermediate direction 17C substantially between the first and second directions 17A and 17B.

The transmission axis of one of the polarization plates 21 and 22, for example, the transmission axis 22A of the upper polarization plate 22, is set substantially parallel to the direction of the normal line to the smectic-phase layer of the liquid crystal 17. The transmission axis 21A of the lower polarization plate 21 is set substantially perpendicular to the transmission axis 22A of the upper polarization plate 22.

The LCD device whose polarization plates 21 and 22 have their transmission axes 21A and 22A set as shown in FIG. 3 has the highest transmittance (brightest display) in the first or second alignment state where the director of the liquid crystal 17 is aligned in the first or second direction 17A or 17B, and has the lowest transmittance (darkest display) when the LC molecules are aligned in the intermediate direction 17C substantially parallel to the direction of the normal line to the smectic-phase layer.

The director of the liquid crystal 17 continuously changes between the first and second directions 17A and 17B in (1)

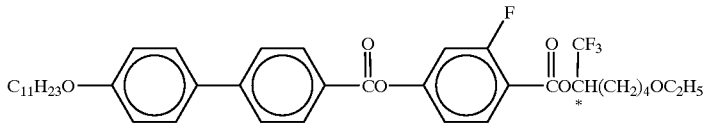

(2)

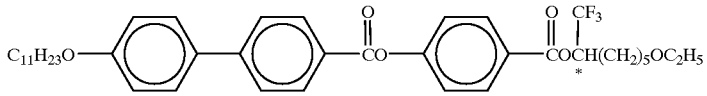

(3)

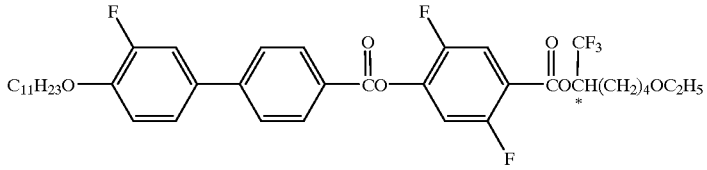

Because the liquid crystal 17 which is an AFLC, for example, has the helical pitch greater than the gap between the substrates 11 and 12, it is sealed between the substrates 11 and 12 with the helical structure nullified. When a voltage which has one polarity and whose absolute value is equal to or greater than a saturation voltage $V_{sat}$ is applied to the liquid crystal 17, the lengthwise axes of most LC molecules of the liquid crystal 17 are aligned in a first direction 17A indicated by a one-dot chain line in FIG. 3, and the dipoles of the LC molecules show a ferroelectric phase. When a voltage which has the other polarity and whose absolute value is equal to or greater than the saturation voltage $V_{sat}$ is applied to the liquid crystal 17, the lengthwise axes of most LC molecules of the liquid crystal 17 are aligned in a accordance with the polarity and the voltage value (absolute value) of the applied voltage. That is, the electro-optical characteristic of the liquid crystal 17 changes continuously and smoothly and becomes a line symmetrical to the vertical scale at the position where the applied voltage is 0. This electro-optical characteristic hardly has a hysteresis. The transmittance of each pixel of this LCD device can therefore be changed continuously by controlling the applied voltage to the liquid crystal 17.

The first example of a method of driving the thus constituted LCD device will be discussed below.

Figures 5A, 5B:
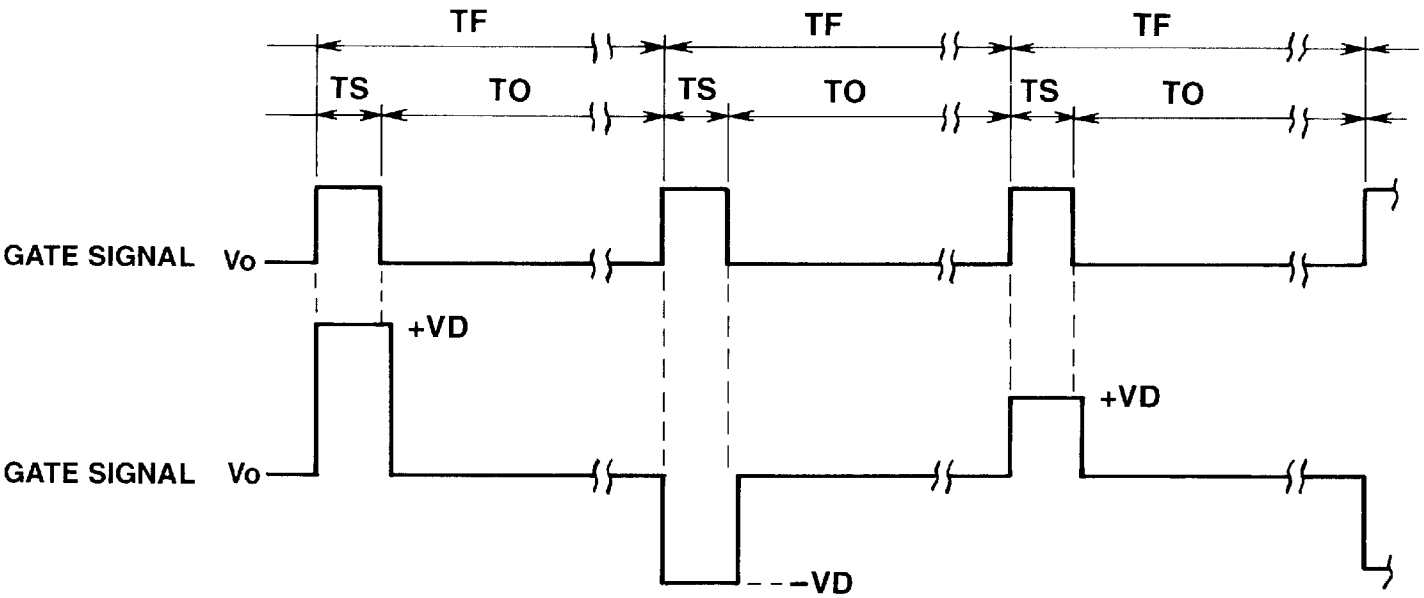
FIG. 5A is a waveform diagram showing a gate pulse used in a method of driving an LCD device according to the first embodiment of this invention.
FIG. 5B is a waveform diagram showing a write voltage used in the method of driving an LCD device according to the first embodiment of this invention.

FIG. 5A shows the waveform of the gate signal to be applied to the each gate line GL by the gate driver 41, and FIG. 5B shows the waveform of the data signal to be applied to each data line DL connected to the associated column of TFTs 31 by the data driver 42.

Referring to FIGS. 5A and 5B, "TF" indicates one frame period, "TS" indicates a selection period for one row of pixels, and "TO" indicates a non-selection period. Each selection period TS is about 60 $\mu$s, for example.

According to this driving method, as shown in FIG. 5B, a single drive voltage (write voltage) VD (or −VD) whose voltage value corresponds to the display gradation is applied to the data line DL in each selection period TS for each frame. With regard to a single piece of display data (display signal), one gradation pulse is applied to the associated pixel in the selection period TS. The polarity of the applied voltage is inverted frame by frame. The polarity and absolute value of the gradation pulse are the polarity and voltage with respect to the reference voltage Vcom.

The write voltage VD (the absolute value when VD has the negative polarity) is controlled within the range of V0 to $V_{max}$ where V0 is the minimum value of the write voltage VD and the maximum value $V_{max}$ is set slightly lower than the voltage ($V_{sat}$ in FIG. 4) by which the saturation of the transmittance occurs. The maximum value $V_{max}$ of this write voltage VD is necessary to incline the director of the LC molecules at a maximum angle with the director of the LC molecules in the antiferroelectric phase. According to this driving method, the liquid crystal 17 can be driven without setting the liquid crystal 17 to the ferroelectric phase where the directions of the LC molecules are aligned in the first or second direction. If the liquid crystal 17 is set to the ferroelectric phase, the electro-optical characteristic of this LCD device has a large hysteresis so that the display characteristic of this LCD device is influenced by the hysteresis. Since this driving method does not set the liquid crystal 17 to the ferroelectric phase, however, the electro-optical characteristic has a small hysteresis, so that the driving of the liquid crystal 17 is less affected by the hysteresis.

According to this driving method, the DC component of the voltage to be applied to the liquid crystal 17 does not completely become 0. This however raises no practical problem because it is very unlikely that an image changes drastically and continuously over several frames and voltages which have substantially the same absolute value and have the opposite polarities are applied to the liquid crystal 17 over a plurality of frames.

The spontaneous polarization Ps, the area S of the pixel electrode 13, the selection period TS for each pixel, and the ON current Ion of the TFTs 31 are so set to satisfy the following equation (5).

$$4\times/Ps\cdot S/TS \leqq Ion \quad (5)$$

Figure 6:
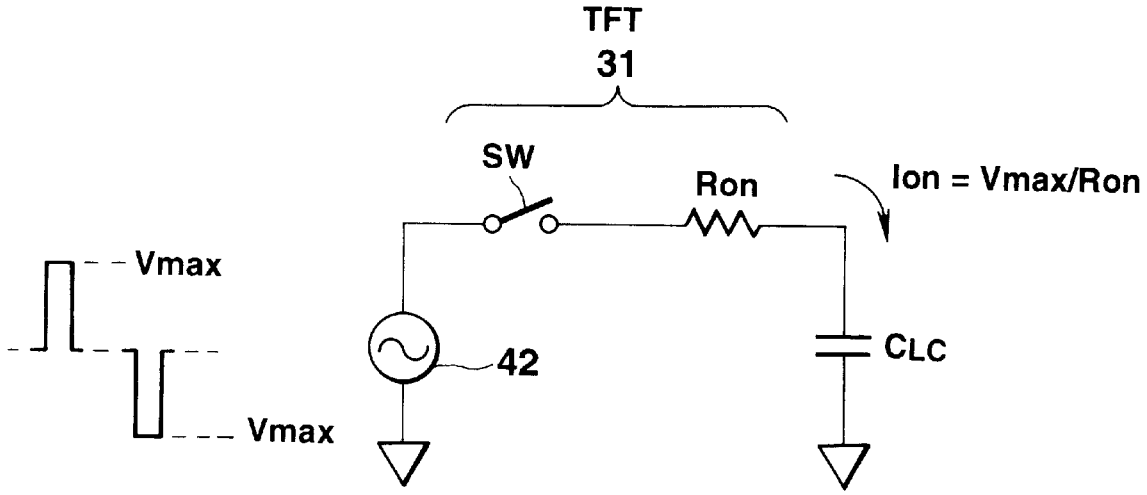
FIG. 6 is a diagram showing an equivalent circuit of each pixel.

The equivalent circuit of each pixel is a series circuit of the data driver 42, a switch SW, the ON resistor Ron of the TFT 31 and an LC capacitor (capacitor comprised of the associated pixel electrode 13, the associated common electrode 14 and the liquid crystal 17 therebetween) $C_{LC}$, as shown in FIG. 6.

Assuming that the impedance of the LC capacitor $C_{LC}$ is sufficiently lower than the ON resistance Ron of the TFT 31 in this equivalent circuit, the ON current Ion is given by the following equation (6).

$$Ion=Vmax/Ron \quad (6)$$

When this LCD device is driven using the gate signal and data signal which have the above-described waveforms, the write voltage VD is applied to the pixel electrode 3 via the associated TFT 31, which is turned on by the gate pulse, in the selection period TS for each row. As a result, the ON current Ion flows through the LC capacitor $C_{LC}$.

When the gate pulse is disabled, resulting in the non-selection period TO, each TFT 31 is turned off so that the voltage corresponding to the write voltage VD is held in the LC capacitor $C_{LC}$. In the non-selection period TO, therefore, the transmittance of the associated pixel is kept at the value corresponding to the voltage retained in the LC capacitor $C_{LC}$ or the value corresponding to the write voltage VD.

In this embodiment, the liquid crystal 17 in use provides the transmittance which continuously changes with a change in applied voltage and the optical arrangement as illustrated in FIG. 3 is employed. Therefore, the transmittance with respect to the absolute value of the write voltage VD is determined specifically, so that clear gradation display can be accomplished by controlling the transmittance by adjusting the absolute value of the write voltage VD.

According to this invention, the individual parameters are so set as to fulfill the equation (5), so that charging the individual pixels within each selection period TS is accomplished almost completely. In other words, the supply of the current necessary to invert the direction of the spontaneous polarization of each LC molecule is completed within the selection period TS so that an arbitrary gradation can be displayed properly. The use of the active elements capable of passing a large drive current Ion allows the liquid crystal 17 with a large spontaneous polarization Ps to be used under the conditions that satisfy the equation (5), thus improving the operation speed. By setting the selection period TS shorter under the conditions that satisfy the equation (5), it is possible to shorten the selection period for each pixel and improve the resolution by increasing the number of rows of pixels (the number of the gate lines GL) with respect to the same frame frequency or improve the frame frequency with respect to the same number of rows of pixels.

The following specifically discusses why the above-described structure shortens the charging time of each pixel.

When the polarization plates 21 and 22 are arranged as shown in FIG. 3 and the LCD device is driven as illustrated in FIG. 5B, the drive current for displaying "white" is the largest. That is, displaying "white" according to this driving method requires that the lengthwise directions of the LC molecules should be alternately set in the first direction 17A and the second direction 17B frame by frame, so that the largest current is needed to alter the alignment state of the liquid crystal 17.

Figure 7A:
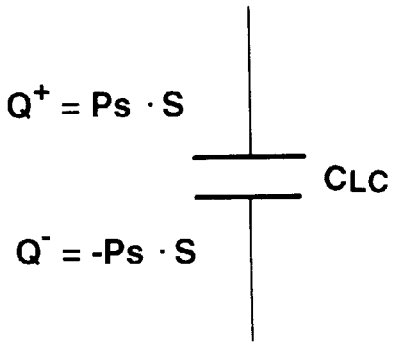
FIGS. 7A and 7B are diagrams showing the relationship between charges retained in the individual pixels of the LCD device and the spontaneous polarization.
Figure 7B:
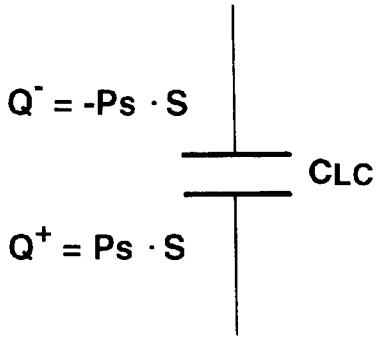

Let us now consider each LC capacitor $C_{LC}$ which is comprised of the associated pixel electrode 13, the associated common electrode 14 and the liquid crystal 17 therebetween. In continuously displaying "white," the spontaneous polarization of the liquid crystal 17 should be inverted frame by frame between the state shown in FIG. 7A and the state shown in FIG. 7B.

In other words, because the spontaneous polarizations of the LC molecules at both surfaces of the liquid crystal 17 influence the charges retained in the LC capacitors $C_{LC}$, the charges at the individual electrodes of each LC capacitor $C_{LC}$ by the spontaneous polarization Ps becomes +Q=+Ps×/S and −Q=−Ps×/S.

Although there are charges of the LC capacitor $C_{LC}$ expressed by the paraelectric term Q'=CV, they are very small as compared with the charges Q induced by the spontaneous polarization Ps and are thus negligible.

Therefore, the amount of charges, ΔQ, needed to be supplied as the drive current to the individual pixels via the associated TFTs 31 from the data driver 42 to invert the spontaneous polarization Ps becomes 2×/Ps×/S.

When the TFTs 31 are turned on by the gate pulse shown in FIG. 5A, a constant write voltage is applied to the associated pixel electrodes 13 as shown in FIG. 5B. The drive current does not maintain a constant value over the selection period TS, but continuously changes in accordance with a change in the alignment of the LC molecules as exemplified by the solid line, the broken line and the one-dot chain line in FIG. 8, which represent the drive currents flowing through the TFTs 31 having different ON resistors with each other.

Figure 8:
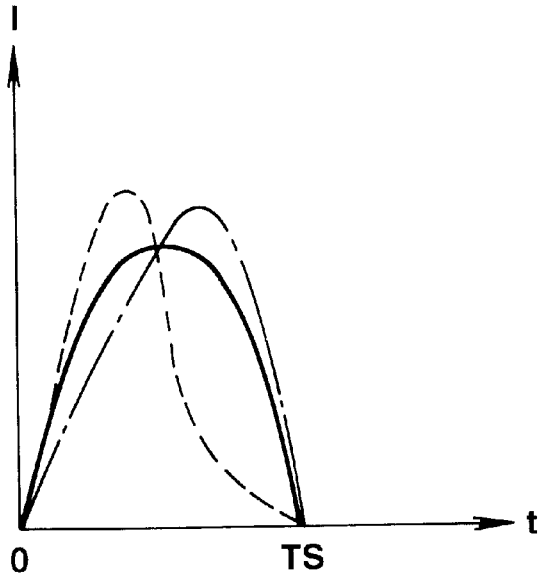
FIG. 8 is a waveform diagram of an ON current to be supplied to the pixels.
Figure 9:
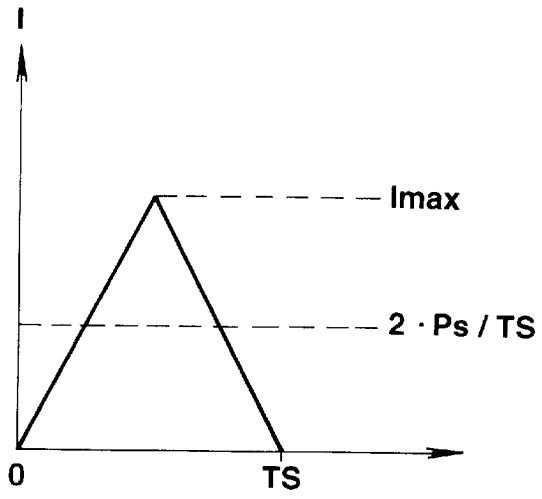
FIG. 9 is a waveform diagram of an isosceles-triangular current similar to the ON current shown in FIG. 8.

The drive current shown in FIG. 8 can be approximated by an isosceles-triangular current as shown in FIG. 9. To supply the charges ΔQ=2×/Ps×/S over the selection period TS, the maximum value Imax of the isosceles-triangular current becomes 4×/Ps×/S/TS. By setting the ON current Ion (i.e., the maximum value Imax of the drive current) of the TFTs 31 greater than 4×/Ps×/S/TS, therefore, it is possible to finish the charging of the LC capacitor $C_{LC}$ and completely invert the spontaneous polarization within the selection period TS.

In the case where "white" is repeatedly displayed over a plurality of frames, therefore, "white" can be displayed properly.

Given that the spontaneous polarization Ps per unit area of the liquid crystal 17 is 150 nc/cm$^2$, the selection period TS is 60$\mu$ and the area S of each pixel is 1 cm×1 cm, the ON current Ion is expressed by the following equation.

$$Ion=4\times/Ps\times/S/TS=4\times/150\times/10^{-9}/60\times/10^{-6}[c/s]=10^{-2}[c/s]$$

If the maximum value Vmax of the write voltage is 10 V, Ron becomes $10/10^{-2}=1$ [KΩ].

Figure 10:
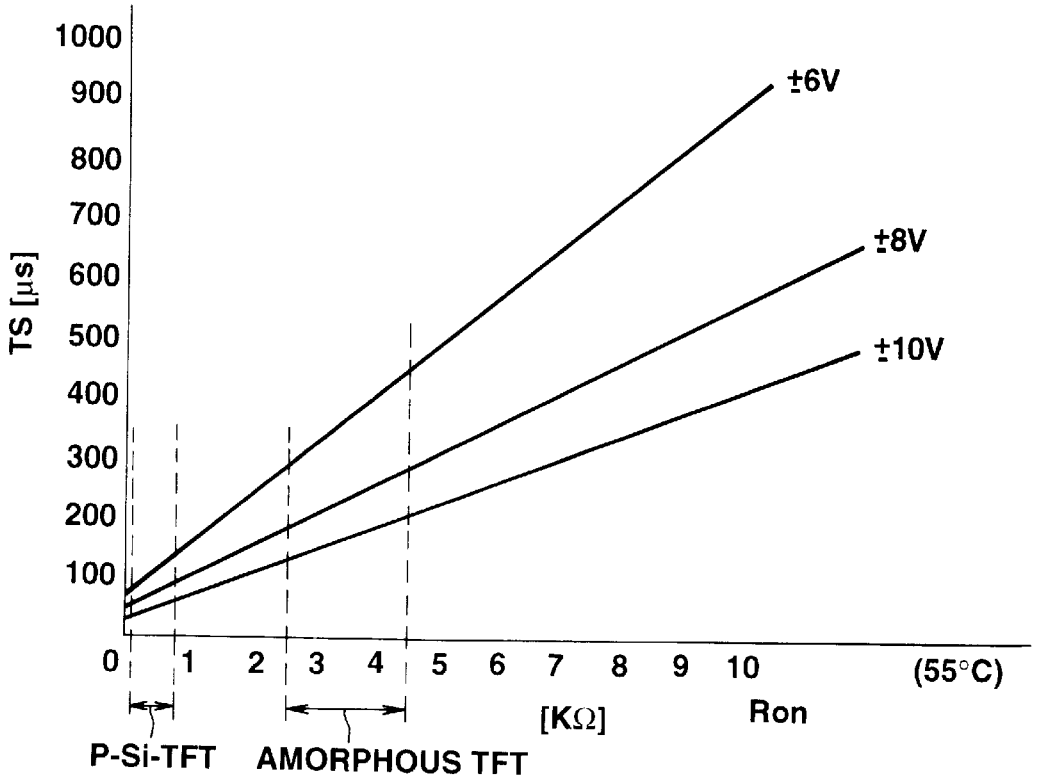
FIG. 10 is a graph illustrating the relationship among a write voltage, a selection time and an ON resistance.

FIG. 10 illustrates the relationship among the maximum value Vmax of the write voltage, the selection period TS and the ON resistance Ron. This relationship is acquired when Ps=150 nC/cm$^2$ and S=1 cm$^2$.

Generally speaking, the ON resistance Ron of a TFT when the area S of each pixel is 1 cm$^2$ is approximately 2.5 KΩ to 4.5 KΩ for an amorphous TFT whose semiconductor layer 36 is made of amorphous silicon, and is approximately 0.1 KΩ to 1 KΩ for a polycrystalline silicon TFT whose semiconductor layer 36 is made of polycrystalline silicon. Given that the actual area of each pixel is S cm$^2$ and the ON resistance of each TFT 31 is R, the TFT's ON resistance Ron when the area S of each pixel is 1 cm$^2$ becomes the total resistance of the resistors R connected in parallel whose quantity is 1/S, i.e., Ron becomes approximately R/S.

The ON current Ion can be increased by, for example, (1) doping the semiconductor layer 36 with an impurity, (2) shortening the channel length and/or widening the channel width, (3) making the gate insulating film 35 thinner, and/or (4) increasing the write voltage VD.

In this respect, the write voltage VD and the ON resistance Ron are so set as to acquire the desired ON current Ion.

Figure 4:
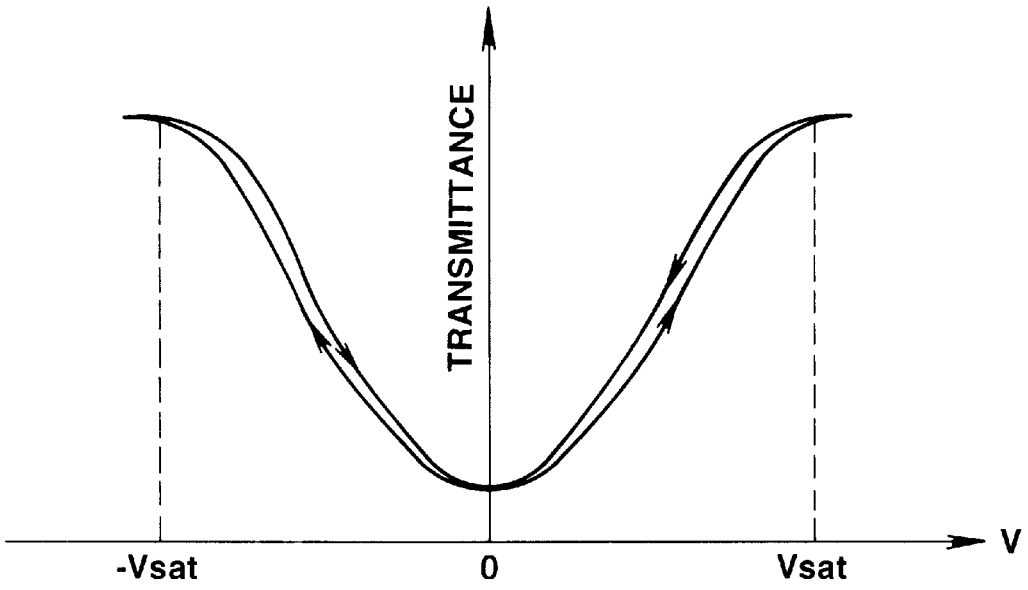
FIG. 4 is a graph illustrating the relationship between the applied voltage and the transmittance.

Although the maximum value $V_{max}$ of the write voltage VD is set lower than Vsat in FIG. 4 in the above-described embodiment, the maximum value $V_{max}$ of the write voltage VD may be set substantially the same as or slightly lower than Vsat so that the liquid crystal 17 can be set to ferroelectric phase.

Although the driving method exemplified in FIGS. 5A and 5B applies a single drive pulse to the liquid crystal 17 with respect to a single piece of display data (a component of the gradation signal for a single pixel), two drive pulses of different polarities may be applied to the liquid crystal 17 in two consecutive frames with respect to one piece of display data. According to this modified driving method, even if the optical characteristic of the liquid crystal 17 varies in accordance with the polarity of the applied voltage, the characteristic is averaged so that high-quality images with less flickering or the like can be displayed.

Second Embodiment

To achieve the objectives of this invention, the ON resistance of the active elements is so set as to satisfy the equation (5) in the first embodiment. This invention is not however limited to this embodiment and the objectives of this invention can be achieved by improving the driving method.

An LCD apparatus which is characterized in its driving method will be discussed below.

Figure 11:
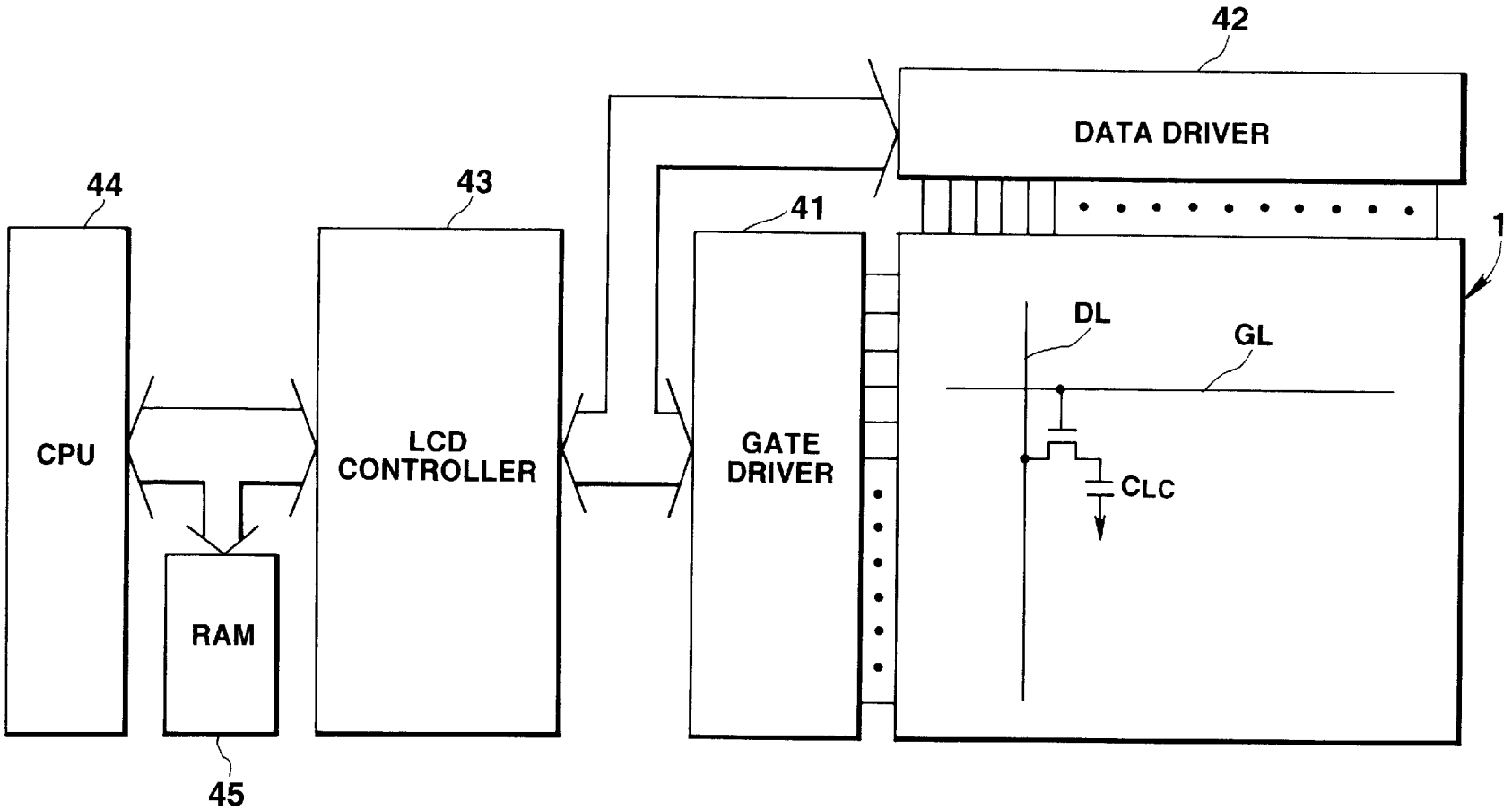
FIG. 11 is a block diagram showing the structure of a drive system for an LCD apparatus according to the second embodiment of this invention.

FIG. 11 is a block diagram showing the structure of the drive system for an LCD apparatus according to the second embodiment of this invention.

In FIG. 11, each of the LC capacitors $C_{LC}$ constituting an LCD device 1 is comprised of the opposing portions of the pixel electrode 13 and the common electrode 14 and the liquid crystal 17 sealed therebetween as shown in FIG. 1.

The individual gate lines GL are connected to the gate driver 41, and the individual data lines DL to the data driver 42.

The gate driver 41 and the data driver 42 are connected to an LCD controller 43, which is further connected to a CPU 44 and a RAM 45 by buses.

The RAM 45 is comprised of a dual-port memory which has a capacity for storing two screens of image data and can accomplish simultaneous writing and reading.

The CPU 44 thins self-produced image data or externally supplied image data to 1/(2×/N+1) where N is a natural number and stores the resultant image data into the RAM 45.

The LCD controller 43 sequentially reads the image data from the RAM 45 every (2×/N+1)-th row, and supplies the image data to the data driver 42. The data driver 42 holds one row (one scan line) of image data, converts this data to an analog voltage signal and applies this signal to the data lines DL.

The LCD controller 43 also supplies a gate switch signal to the gate driver 41. In response to the gate switch signal, the gate driver 41 switches the gate pulse to sequentially select every (2×/N+1)-th gate line GL.

The operation clock for the CPU 44 to write image data into the RAM 45 is approximately (2·N+1) times the operation clock for the LCD controller 43 to read image data from the RAM 45.

A description will now be given of the operation of the thus constituted LCD device in the case where N=1.

Figures 12A, 12B, 12C, 12D, 12E, 12F:
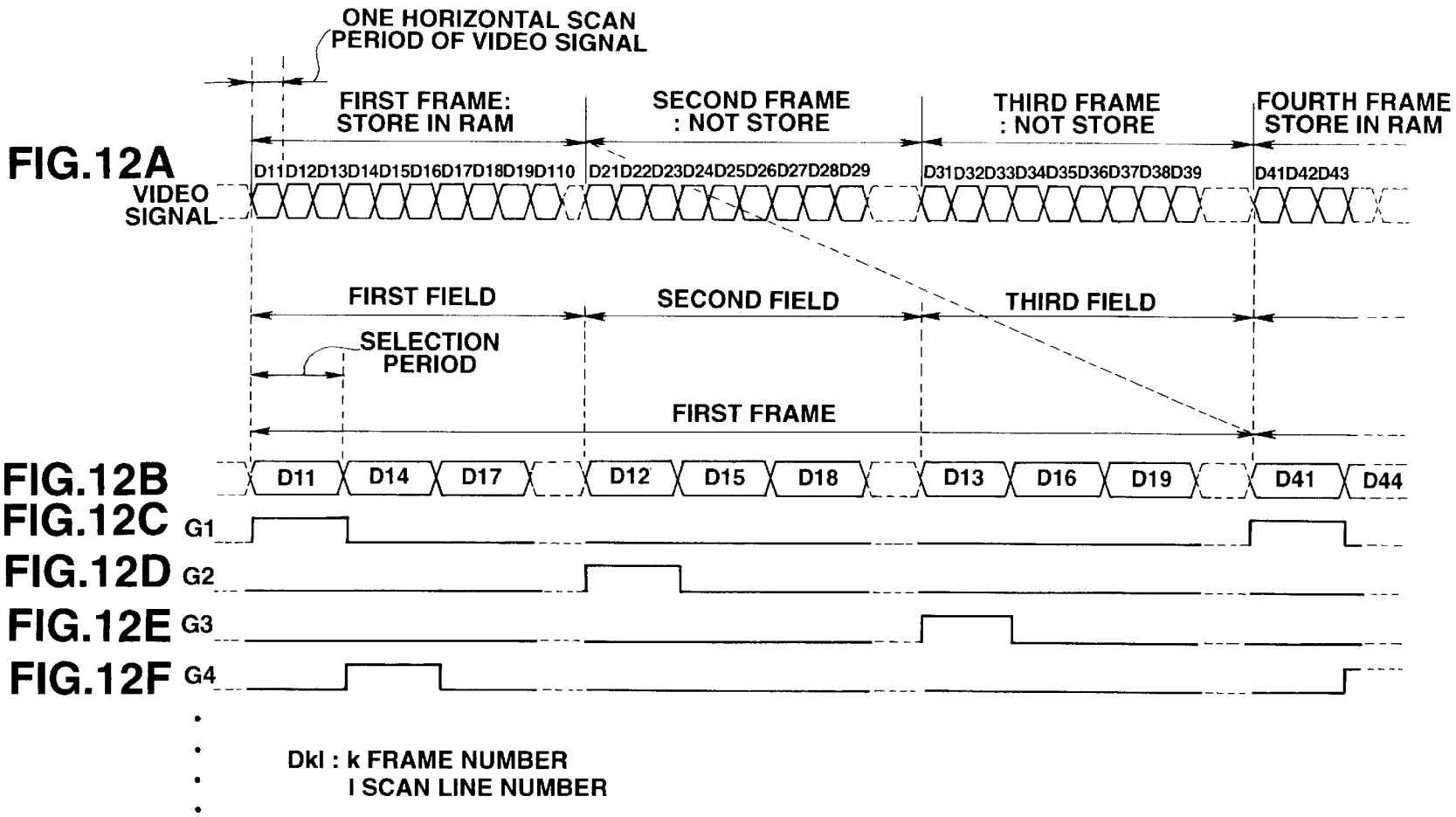
FIGS. 12A through 12F are timing charts for explaining the operation of the LCD apparatus according to the second embodiment.

First, the CPU 44 produces image data (display data) at the timing illustrated in FIG. 12A. This image data is sequentially stored in the RAM 45.

At this time, the CPU 44 stores the first frame of image data, the fourth frame of image data, the seventh frame of image data and so forth into the RAM 45 and discards the second frame of image data, the third frame of image data, the fifth frame of image data, the sixth frame of image data and so forth without storing them in the memory. Accordingly, image data is thinned to 1/(2×/N+1).

The LCD controller 43 reads image data for the first scan line from the image data stored in the RAM 45 and supplies the read image data to the data driver 42. As shown in FIG. 12B, the data driver 42 holds the image data D11 for the first scan line supplied from the LCD controller 43, performs D/A conversion and level conversion of the image data D11, and then applies the resultant signal to the data lines DL in parallel. The application time is about three times one horizontal scan period of a video signal.

The gate driver 41 applies the gate pulse to the first gate line G1 substantially in synchronism with the timing at which the data D11 is output onto the data line DL. The width of the gate pulse is approximately three times one horizontal scan period of the video signal.

The associated TFTs 31 are turned on by this gate pulse, allowing image data (voltage signal) to be applied to the associated LC capacitors $C_{LC}$. In accordance with this image data, the molecules of the liquid crystal 17 are aligned. As the selection period is three times the selection period in the normal driving method (which is approximately equal to one horizontal scan period of a video signal), sufficient charges are stored in the LC capacitor $C_{LC}$ though the capacitance of each LC capacitor $C_{LC}$ is several times to several tens of times greater than the LC capacitor of the LCD device which uses a nematic liquid crystal. Accordingly, a voltage corresponding to image data is applied between the electrodes to align the molecules of the liquid crystal 17 in accordance with the image data and this alignment state is maintained.

Then, the LCD controller 43 reads the fourth row of image data D14 from the RAM 45 and supplies the image data D14 to the data driver 42. The data driver 42 applies this image data D14 to the data lines DL, as shown in FIG. 12B. Further, the gate driver 41 applies the gate pulse to the fourth gate line G4 as shown in FIG. 12F so that the molecules of the liquid crystal 17 for the fourth row of pixels are aligned according to the image data D14.

Thereafter, the LCD controller 43 likewise reads the seventh row of image data D17, the tenth row of image data D110 and so forth from the RAM 45 every 3(2×/N+1)-th row, and the data driver 42 applies the supplied image data D17, D110 and so forth to the associated data lines DL. The gate driver 41 applies the gate pulse to the seventh gate line G7 and so forth in synchronism with the image data D17, D110 etc.

When scanning of the first field is finished in this manner, the LCD controller 43 reads image data D12 of the second row of pixels in the first frame and supplies it to the data driver 42. The data driver 42 applies the image data D12 to the data lines DL. The gate driver 41 applies the gate pulse to the second gate line G2 to write the image data D12 into the second row of pixels as shown in FIG. 12D.

Thereafter, image data D15, D18 and so forth are likewise written in the fifth row of pixels, the eighth row of pixels and so forth.

When scanning of the second field is finished in this manner, the LCD controller 43 reads image data D13 of the third row of pixels in the first frame and supplies it to the data driver 42. The data driver 42 applies the image data D13 to the data lines DL. The gate driver 41 applies the gate pulse to the third gate line G3 to write the image data D13 into the third row of pixels as shown in FIG. 12E.

Thereafter, image data D16, D19 and so forth are likewise written in the sixth row of pixels, the ninth row of pixels and so forth.

Through the above-described operation, all the rows of the LCD device 1 from the first row to the last row are scanned over the period of three frames of image data and the first frame of image data is written in each row of pixels, thus completing the writing of one screen.

During this period, the CPU 44 stores the fourth frame of image data in the empty area in the RAM 45.

Subsequently, the LCD controller 43 sequentially reads image data D41 of the first row of pixels, image data D44 of the fourth row of pixels, image data D47 of the seventh row of pixels and so forth in the fourth frame stored in the RAM 45, and supplies those image data to the data driver 42. The data driver 42 applies the supplied image data to the associated data lines DL. The gate driver 41 sequentially applies the gate pulse to the first gate line G1, the fourth gate line G4, the seventh gate line G7 and so forth.

Thereafter, the same operation is repeated.

In this manner, the LCD device 1 is scanned three times, every three lines and image data is written in all the pixels over the three-frame period of image data.

According to this driving method, the selection period for each pixel becomes three times the selection period in the normal driving method. Therefore, sufficient charges can be stored in the LC capacitors $C_{LC}$ of the LCD device whose liquid crystal has the LC molecules having the spontaneous polarization.

As adjoining three scan lines are selected in order over three fields, flickering of the adjoining three scan lines is averaged, so that the flickering hardly appears even though the frame frequency becomes low.

Figure 13:
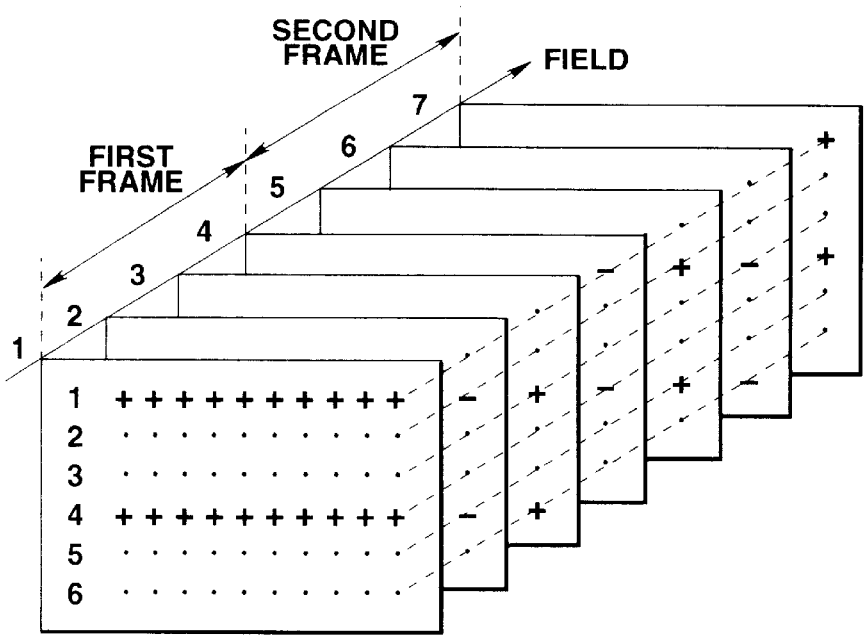
FIG. 13 is a diagram for explaining the polarity of a voltage to be applied to the liquid crystal.

The above-discussed driving method is exemplarily illustrated in FIG. 13. When N=1, the first row of pixels, the fourth row of pixels and so forth are sequentially selected in the first field, and individual pieces of image data in the first frame of a video signal are applied between the electrodes over a period three times the selection period involved in the normal driving method.

In the second field, the second row of pixels, the fifth row of pixels and so forth are sequentially selected, and the second image data, the fifth image data and so forth in the first frame of the video signal are written in the associated pixels. At this time, the voltage to be applied to the liquid crystal 17 is set to the negative polarity unlike the one for the first frame in order to prevent burning of the liquid crystal 17. Because the liquid crystal 17 has the optical characteristic shown in FIG. 4, however, the transmittances (display luminances) with respect to positive and negative voltages whose absolute values are equal to each other are approximately the same. Even if the polarity of the applied voltage is inverted field by field, therefore, no luminance deviation occurs.

In the third field, the third row of pixels, the sixth row of pixels and so forth are sequentially selected, and the video signal is applied. The voltage to be applied to the liquid crystal 17 has the positive polarity.

In those three fields, the scanning of the LCD device based on the first frame of the video signal is completed.

Then, the scanning of the LCD device based on the fourth frame of the video signal starts, and the first row of pixels, the fourth row of pixels and so forth are selected in the first field and the video signal is applied. The voltage to be applied to the liquid crystal 17 is set to the negative polarity unlike the one for the first frame.

This driving method can prevent the burning of the liquid crystal.

Figure 14:
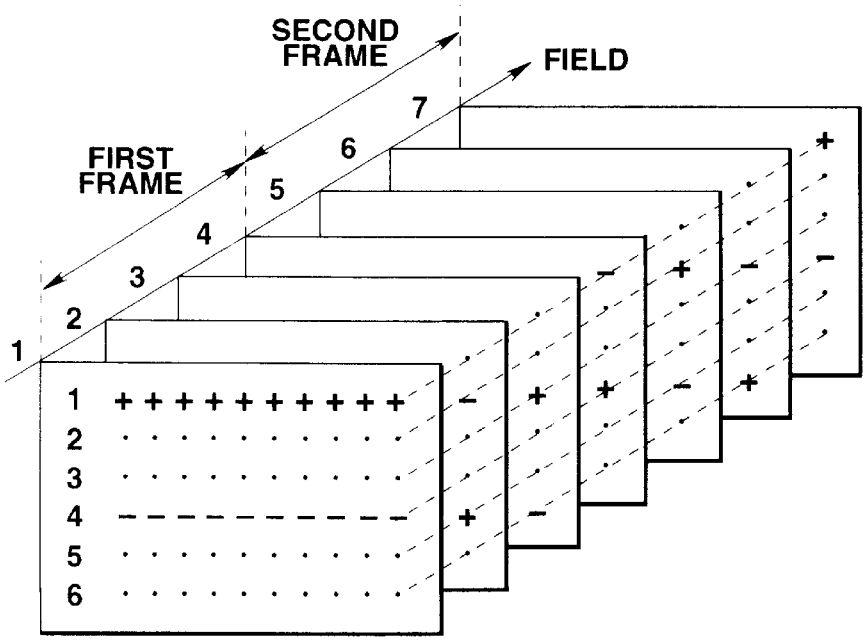
FIG. 14 is a diagram for explaining the polarity of a voltage to be applied to the liquid crystal.
Figure 15:
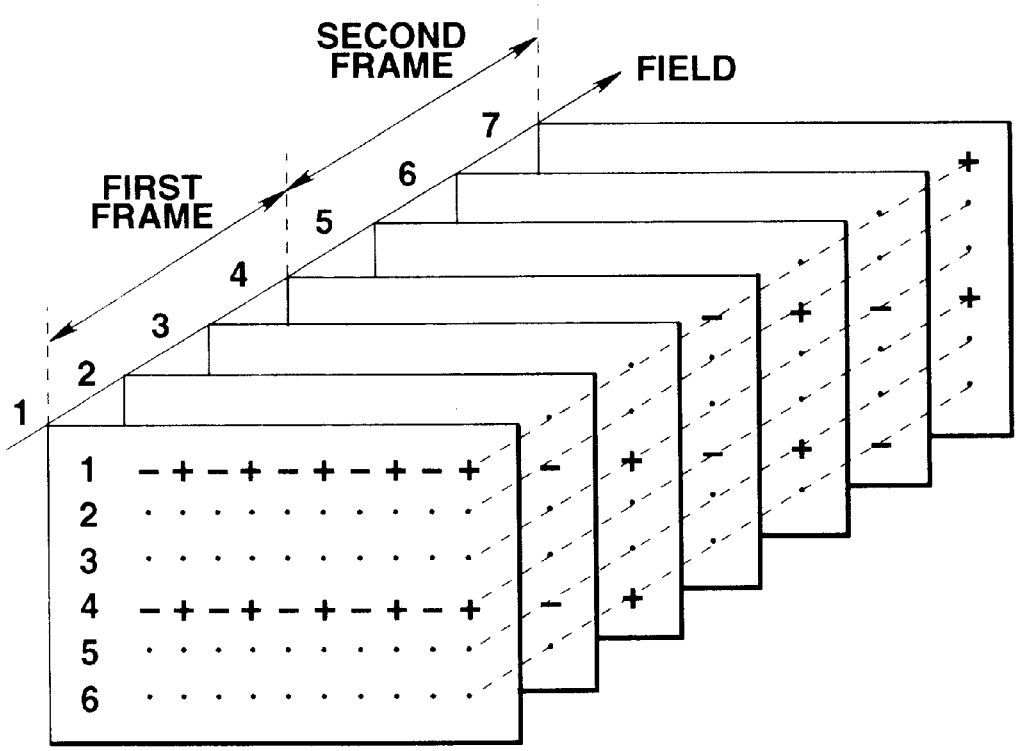
FIG. 15 is a diagram for explaining the polarity of a voltage to be applied to the liquid crystal.

Although the data driver 42 alters the polarity of the voltage to be applied to the liquid crystal 17 field by field (field inversion) in FIG. 13, the polarity may be inverted line by line as shown in FIG. 14. In this case, line inversion is performed, i.e., the polarity of the applied voltage is changed line by line to be selected, and further, the polarity of the voltage to be applied to the liquid crystal 17 of the individual pixels is inverted frame by frame. As shown in FIG. 15, the polarity of the applied voltage is inverted for each row of pixels and further the polarity of the voltage to be applied to the liquid crystal 17 at the individual pixels Is inverted frame by frame.

Third Embodiment

In the second embodiment, the frame frequency of the LCD device is set to 1/(2×/N+1) of the frame frequency of a video signal. That is, while the first frame, the fourth frame, the seventh frame and so forth, for example, are displayed, the second frame, the third frame, the fifth frame, the sixth frame and so forth are discarded. A "frame loss" may therefore occur in displaying moving pictures or the like. This problem becomes prominent particularly when N is large.

This problem can be avoided by storing each frame of data of a video signal in the RAM 45, thinning each frame of video signals to 1/(2×/N+1) and writing the resultant signals in the associated pixels.

The following describes the embodiment that executes such driving.

The structure of the LCD apparatus according to this embodiment is basically the same as the structure of the first embodiment illustrated in FIGS. 11 and 12, and the following description will be centered on the operation of the LCD apparatus with reference to timing charts in FIGS. 16A through 16F.

Figures 16A, 16B, 16C, 16D, 16E, 16F:
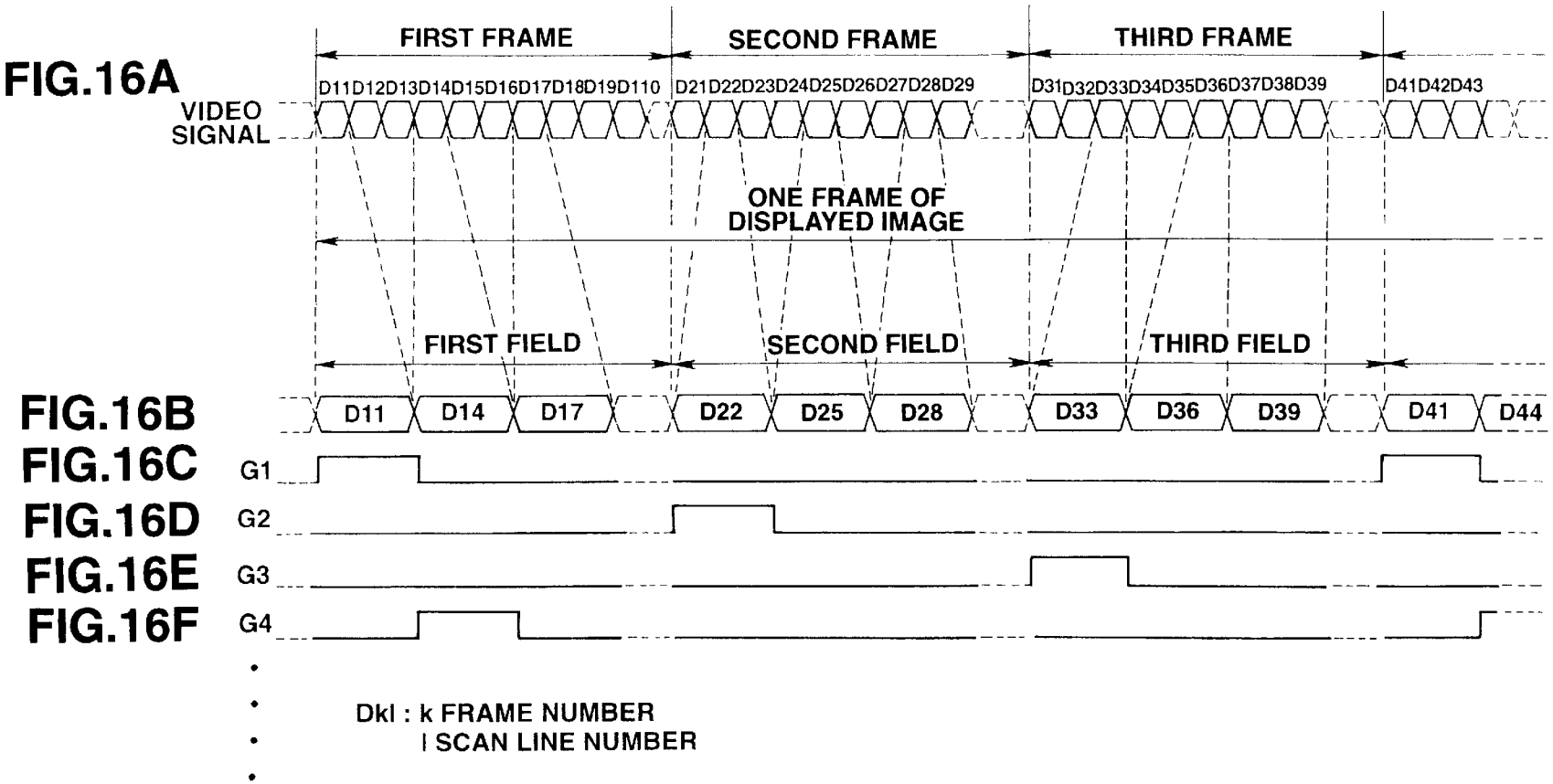
FIGS. 16A through 16F are timing charts for explaining the operation of an LCD apparatus according to the third embodiment of this invention.

The CPU 44 stores individual pieces of image data of a video signal, supplied at the timing shown in FIG. 16A, into the RAM 45 as in the normal case. The storing speed is the same as the one in the normal driving operation.

The LCD controller 43 reads individual frames of video signals every (2×/N+1)-th line in each period which is three times one horizontal scan period of the video signals, and supplies the read signals to the data driver 42 in the horizontal scan period of the video signals. As a result, the video signals are thinned to 1/(2×/N+1).

When N=1, for example, the LCD controller 43 sequentially reads image data D14 of the first row of pixels, image data D14 of the fourth row of pixels and so forth and supplies those image data to the data driver 42. The image data reading period is approximately three times one horizontal scan period.

The data driver 42 applies the supplied image data D11, D14, etc. to the associated data lines DL over a period three times the horizontal scan period of the video signals, as shown in FIG. 16B.

As shown in FIGS. 16C and 16F, the gate driver 41 sequentially applies the gate pulse to the first gate line G1, the fourth gate line G4 and so forth.

In this manner, the first frame of video signals are thinned to 1/(2×/N+1) and the thinned video signals are sequentially written in the LCD device 1.

During this period, the second frame of video signals are stored in the RAM 45.

When the reading of the first frame of video signals is completed, the LCD controller 43 reads image data D22 of the second scan line, image data D25 of the fifth scan line, etc. in the second frame of video signals stored in the RAM 45 and supplies those image data to the data driver 42 in order. The data driver 42 supplies the received image data D22, D25 and so forth to the associated data lines DL as shown in FIG. 16B.

The gate driver 41 sequentially applies the gate pulse to the second gate line G2, the fifth gate line G5 and so forth.

In this manner, the second frame of video signals are thinned to 1/(2×/N+1) and the thinned video signals are sequentially written in the LCD device 1.

When the reading of the second frame of video signals is completed, the LCD controller 43 reads image data D33 of the third scan line, image data D36 of the sixth scan line, etc. in the third frame of video signals stored in the RAM 45 and supplies those image data to the data driver 42 in order. The data driver 42 supplies the received image data D33, D36 and so forth to the associated data lines DL as shown in FIG. 16B.

The gate driver 41 sequentially applies the gate pulse to the third gate line G3, the sixth gate line G6 and so forth.

In this manner, the third frame of video signals are thinned to 1/(2×/N+1) and the thinned video signals are sequentially written in the LCD device 1.

Thereafter, the same operation is repeated.

In this driving method, the frequency of the data transfer between the CPU 44 and the RAM 45 is set to the normal frequency, and the frequency of the signal transfer between the data driver 42 and the gate driver 41 is set to 1/(2×/N+1) of the normal frequency.

It is therefore possible to lengthen each of the selection period to substantially (2×/N+1) times the selection period in the normal driving method. Accordingly, sufficient charges can be charged in the LC capacitors $C_{LC}$ during the selection period, allowing the alignment of the LC molecules having the spontaneous polarization to be clearly associated with the applied voltage.

Because the image data D11, D14 and D17 are displayed in the first field of the LCD device by thinning the first frame of video signals, the image data D22, D25 and D28 in the second frame are displayed in the second field and the image data D33, D36 and D39 in the third frame are displayed in the third field, the video signals are not lost in the units of frames. Therefore, a so-called frame loss does not occur and moving pictures can be displayed in a smooth motion.

The second and third embodiments may be modified as follows.

For instance, the flicker frequency can be set equal to the frame frequency of video signals without performing the aforementioned line inversion, by setting the data transfer-frequency between the CPU 44 and the RAM 45 to the normal frequency and setting the data-transfer frequency between the RAM 45 and the LCD controller 43 and between the data driver 42 and the gate driver 41 to 2/(2·/N+1) of the frequency of the operation between the CPU 44 and the RAM 45.

Although the foregoing descriptions of the second and third embodiments have been mainly on the case where N=1, N can be any natural number. As N increases, the selection period becomes longer so that the writing time can be elongated. In this case, however, the frame frequency decreases so that flickering becomes prominent. The optimal N is therefore set in accordance with the size of the LCD device, the number of scan lines and so forth.

Although an AFLC is used as the liquid crystal 17 having a spontaneous polarization in the first to third embodiments, a DHF liquid crystal or an SBF liquid crystal which are ferroelectric liquid crystals may also be used. In the case where the latter two liquid crystals are used, the optical axes of the polarization plates 21 and 22 are set with the direction of the normal line of the chiral smectic phase taken as a reference as shown in FIG. 3, for example.

The structure of the LCD device and the structure of the driving circuit, for example, can be arbitrarily changed. Although the foregoing description has been given with reference to the case where this invention is adapted to a TFT LCD device which uses TFTs as active elements, this invention can also adapted to an LCD device which uses non-linear 2-terminal elements like MIMs as active elements.

The optical axes of the polarization plates may be set to a direction different from the one shown in FIG. 3.

For example, the transmission axis 22A of the polarization plate 22 may match with the direction of the normal line of the chiral smectic phase, while the transmission axis 21A of the other polarization plate 21 may be set perpendicular to the transmission axis 22A.

The transmission axes 21A and 22A of the polarization plates 21 and 22 may be set parallel to each other. In this case, the transmittance becomes the lowest (darkest display) in the first or second alignment state where the director of the liquid crystal 17 is set in the first or second direction 17A or 17B, and the transmittance becomes the highest (brightest display) in the alignment state where the director of the liquid crystal 17 is set in the intermediate direction 17C. Therefore, the driving power of the driving circuit can be reduced by changing the directions of the polarization plates in accordance with whether to present "bright" display or "dark" display.

What is claimed is:

1. A liquid crystal display device comprising:

a first substrate having pixel electrodes and active elements, connected to said pixel electrodes, formed thereon in a matrix form;

a second substrate having common electrodes formed thereon facing said pixel electrodes; and a liquid crystal located between said first and second substrates and having a spontaneous polarization, wherein each of said active elements controls current supply to said pixel electrodes, and said active elements are formed in such a manner that an allowable ON current of said active elements satisfies an equation (7):

$$4 \times Ps \times S/TS \leqq Ion \quad (7)$$

where S is an area of each pixel, Ps is a spontaneous polarization per unit area, TS is a selection time of each pixel and Ion is said ON current.

2. The liquid crystal display device according to claim 1, wherein said liquid crystal has liquid crystal molecules, and a director of said liquid crystal molecules is aligned substantially in a first direction when a voltage having a first polarity and equal to or greater than a first value is applied to said liquid crystal, and said liquid crystal molecules of said liquid crystal are aligned substantially in a second direction when a voltage having a second polarity and equal to or greater than said first value is applied to said liquid crystal; and each of said active elements has an ON resistance satisfying an equation (8):

$$V1/Ion \geqq Ron \quad (8)$$

where V1 is a voltage of said first value, Ion is said ON current of said active elements when said voltage with said first value V1 is applied to said liquid crystal, and Ron is said ON resistance.

3. The liquid crystal display device according to claim 1, further comprising a pair of polarization plates sandwiching said first and second substrates; and wherein said liquid crystal has liquid crystal molecules, and a director of said liquid crystal molecules is aligned substantially in a first direction when a voltage having a first polarity and equal to or greater than a first value is applied to said liquid crystal, and the director of said liquid crystal molecules of said liquid crystal is aligned substantially in a second direction when a voltage having a second polarity and equal to or greater than said first value is applied to said liquid crystal;

an optical axis of one of said pair of polarization plates is set to an intermediate direction between said first direction and said second direction; and an optical axis of the other one of said pair of polarization plates is set perpendicular or parallel to said optical axis of said optical axis of said one polarization plate.

4. The liquid crystal display device according to claim 1, further comprising a driving circuit, connected to said pixel electrodes via said active elements, for applying voltages of different polarities to said pixel electrodes frame by frame with a voltage for said common electrodes taken as a reference.

5. The liquid crystal display device according to claim 4, wherein said driving circuit applies one drive pulse to said liquid crystal with respect to one piece of display data for each pixel electrode while inverting a polarity of said drive pulse frame by frame.

6. The liquid crystal display device according to claim 4, wherein said driving circuit applies two drive pulses of different polarities to said liquid crystal in two consecutive frames with respect to one piece of display data for each pixel electrode.

7. The liquid crystal display device according to claim 1, wherein said liquid crystal is one of an antiferroelectric liquid crystal, DHF liquid crystal and SBF liquid crystal.

8. A liquid crystal display apparatus comprising:

a liquid crystal display device including a first substrate having pixel electrodes and active elements, connected to said pixel electrodes, formed thereon in a matrix form, a second substrate having common-electrodes formed thereon facing said pixel electrodes, and a liquid crystal located between said first and second substrates and having a spontaneous polarization; and a driving circuit connected to said pixel electrodes via said active elements, whereby a drive current to be supplied via said active elements to capacitors, which are comprised of said pixel electrodes, said common electrodes and said liquid crystal therebetween, change with time in accordance with a change in alignment of said liquid crystal, wherein each of said active elements controls current supply to said pixel electrodes, and said active elements have an allowable current characteristic equal to or greater than a maximum value of said drive current satisfying an equation (9):

$$4 \times Ps \times S/TS \approx Imax \quad (9)$$

where S is an area of each pixel, Ps is a spontaneous polarization per unit area, TS is a selection time of each pixel and Imax is said maximum value of said drive current.

9. The liquid crystal display apparatus according to claim 8, wherein each of said active elements has an ON resistance satisfying an equation (10):

$$V_{max}/I_{max} \geq R_{on} \quad (10)$$

where Imax is said maximum value of said drive current to be supplied to said capacitors, Vmax is a maximum value of a voltage to be applied to said pixel electrodes and said common electrodes by said driving circuit, and Ron is said ON resistance.

10. A liquid crystal display apparatus comprising:

a liquid crystal display device including a first substrate having pixel electrodes and active elements, connected to said pixel electrodes, formed thereon in a matrix form, a second substrate having common electrodes formed thereon facing said pixel electrodes, and a liquid crystal located between said first and second substrates and having a spontaneous polarization; and drive means for selecting every (2×N+1)th row of pixels of said liquid crystal display device and writing image data in said selected row of pixels in each field and changing a row to be selected field by field, thereby displaying one screen by (2×N+1) fields, N being a natural number, wherein each of said active elements controls current supply to said pixel electrodes.

11. The liquid crystal display apparatus according to claim 10, wherein said drive means comprises:

reception means for receiving image data defining a write voltage to each pixel;

thinning means for thinning each frame of image data in said image data received by said reception means to 1/(2×N+1); and means for applying Image data thinned by said thinning means to pixels of said liquid crystal display device for a time substantially (2×N+1) times a continuation period of said image data.

12. The liquid crystal display apparatus according to claim 10, wherein said drive means comprises:

reception means for receiving image data defining a write voltage to each pixel;

selection means for selecting one frame of image data in every (2×N+1) frames of image data received by said reception means; and means for applying said frame of image data selected by said selection means to pixels of said liquid crystal display device for a time substantially (2×N+1) times a continuation period of said image data.

13. The liquid crystal display apparatus according to claim 10, wherein said drive means comprises:

storage means for receiving image data defining a display image at a predetermined reception speed and storing said image data at a frame speed of said image data;

reading means for reading every (2×N+1)th row of image data from said storage means at a speed 1/(2×N+1) times said reception speed; and means for applying said image data, read by said reading means, to selected pixels.

14. The liquid crystal display apparatus according to claim 10, wherein:

said first substrate has said pixel electrodes arranged in a matrix form, thin film transistors respectively connected to said pixel electrodes at one ends of current paths of said thin film transistors, a plurality of gate lines each connected to gates of an associated row of said thin film transistors, and a plurality of data lines each connected to other ends of said current paths of an associated column of said thin film transistors, formed thereon; and said drive means includes a gate driver for applying a gate pulse to every (2×N+1)th row of gate lines and a data driver for outputting said image data to said data lines.

15. A liquid crystal driving method comprising the steps of:

receiving image data;

thinning said image data to 1/(2×N+1);

selecting every (2×N+1)th row of pixels of an active matrix type liquid crystal display device using a liquid crystal having a spontaneous polarization, and changing a row to be selected field by field; and writing said thinned image data to said selected pixels.

16. The liquid crystal driving method according to claim 15, wherein:

a continuation period of said thinned image data is elongated to substantially (2×N+1) times an original continuation period; and each pixel of said liquid crystal display device is selected for a period substantially (2×N+1) times said continuation period of each image data and said thinned image data is written in said selected each pixel.

17. The liquid crystal driving method according to claim 15, wherein at a time of writing thinned image data in selected pixels, a polarity of a voltage to be applied to said liquid crystal of said liquid crystal display device is inverted field by field.

18. The liquid crystal driving method according to claim 15, wherein at a time of writing thinned image data in selected pixels, a polarity of a voltage to be applied to said liquid crystal of said liquid crystal display device is inverted line by line.

19. The liquid crystal driving method according to claim 15, wherein at a time of writing thinned image data in selected pixels, a polarity of a voltage to be applied to said liquid crystal of said liquid crystal display device inverted frame by frame.

* * * * *

UNITED STATES PATENT AND TRADEMARK OFFICE

CERTIFICATE OF CORRECTION

PATENT NO. : 6,069,602
DATED : May 30, 2000
INVENTOR(S) : Tomio Tanaka et al.

It is certified that error appears in the above-identified patent and that said Letters Patent is hereby corrected as shown below:

Title page,Item [57],
Abstract, line 10, after "4 x Ps x S/TS" insert --≤ Ion --.

Signed and Sealed this

Twenty-fifth Day of September, 2001

*Attest:*

Nicholas P. Godici

NICHOLAS P. GODICI
*Acting Director of the United States Patent and Trademark Office*

*Attesting Officer*